United States Patent [19]

Cunningham

[11] 4,226,691

[45] Oct. 7, 1980

[54] BUBBLE MEMORY PROCESS USING AN ALUMINUM PLUS WATER CHEMICAL REACTION

[75] Inventor: James A. Cunningham, Saratoga, Calif.

[73] Assignee: National Semiconductor Corporation, Santa Clara, Calif.

[21] Appl. No.: 963,308

[22] Filed: Nov. 24, 1978

[51] Int. Cl.[3] ..... C23C 15/00; H01F 10/02

[52] U.S. Cl. ..... 204/192 E; 427/123; 427/130; 427/131; 427/132; 427/259; 428/900

[58] Field of Search ..... 427/130, 131, 132, 48, 427/123, 259; 428/900; 204/192 E

[56] References Cited

U.S. PATENT DOCUMENTS

| | | | |
|---|---|---|---|
| 3,957,552 | 5/1976 | Ahn et al. | 427/131 X |
| 4,098,917 | 7/1978 | Bullock et al. | 427/132 X |
| 4,104,422 | 8/1978 | Sandfort | 427/132 X |

OTHER PUBLICATIONS

IEEE Transactions on Magnetics, vol. Mag. 12, No. 6, Nov. 1976, Rose.

*Primary Examiner*—Bernard D. Pianalto
*Attorney, Agent, or Firm*—Brown & Martin

[57] ABSTRACT

Disclosed is a process for fabricating magnetic bubble memory chips from a magnetic film having an insulating layer on one surface thereof. The process involves forming an aluminous layer of a first substantially uniform thickness on the insulating layer. Subsequently, a layer of water insoluble material is formed on the aluminous layer, and a mask for patterning control conductors for the memory is formed on the water insoluble layer. Later, all regions of the water insoluble layer that are not covered by the mask are removed, and all regions of the aluminous layer that are not covered by the mask are thinned to a second substantially uniform thickness. The thinned aluminous regions are converted to $Al_2O_3$ by a chemical reaction with water; while the remaining regions of the aluminous layer remains unchanged. This reaction forms a plurality of patterned control conductors of the first thickness with $Al_2O_3$ regions also being of the first thickness lying therebetween.

8 Claims, 7 Drawing Figures

BUBBLE MEMORY PROCESS USING AN ALUMINUM PLUS WATER CHEMICAL REACTION

BACKGROUND OF THE INVENTION

This invention relates to bubble memories and their methods of fabrication. Over the last several years, much effort has been put into improving bubble memory fabrication processes in order to increase chip yield. One of the known factors that reduce chip yield is the existence of "steps" in the permalloy patterns as they cross over the various control conductors in the memory. Basically, the permalloy patterns provide bubble propagation paths in the memory, whereas the control conductors provide means for generating bubbles, transferring bubbles from one propagation path to another, and replicating bubbles. To implement these functions, the permalloy patterns are required to cross over the control conductors. However, it is well known that a step in the permalloy as it crosses over the conductor edge introduces a discontinuity in the magnetization of the permalloy. And the discontinuity sets up a barrier to bubble propagation. This in turn degrades the operating margins for the rotating and bias magnetic fields, and thus reduces chip yield.

To overcome this problem, various so called planar processes have been proposed. See for example, an article by J. P. Reekstin and R. Kowalchuck in the IEEE Transactions on Magnetism, Volume 9, page 485 (1973). See also, an article by D. K. Rose, IEEE Transactions on Magnetism, Volume 12, page 618, (1976). None of these proposed processes however, have been utilized to fabricate large capacity chips partly because they are too complicated to obtain good process yields.

Further, a "resist lift-off" step that is used in a planar process, is undesirable because it forms edge contours that are basically unreproducable. Prior to the lift-off step, the control electrodes are formed by patterning a layer of resist on an aluminous layer. Then the aluminous layer is patterned by either chemical etching or ion-milling. Subsequently, an insulating layer is formed over both the resist and the spaces lying therebetween. Then the "lift-off" step is performed to lift-off both the resist and the insulating material lying on top of the resist.

Ideally, the insulating material that remains in the regions between the conductors is of the same thickness as the conductors. And thus, no step occurs at the junction between the two. One problem however, is that during the lift-off step the insulating material that overlies the conductor cracks as the resist is being lifted off. Thus, a jagged unreproducable edge occurs at the junction between the conductors and the insulating material that remains after lift-off. This edge has a random shape that includes both peaks and valleys. And they in turn adversely affect bubble propagation and chip yield.

Further, the lift-off step can randomly cause pinhole shorts to occur at the junction between the conductors and the insulating material. These pinholes may be due to the cracking of the insulating material during lift-off as described above. But in addition, if the conductors are formed by chemical etching, the pinholes will be increased by undercutting of the resist. This undercutting results in a void in the undercut regions as the insulating region is formed on top of the resist and the areas therebetween. Then after lift-off, a gap exists between the conductors and the insulating material that remains.

Accordingly, it is one object of the invention to provide an improved method of fabricating magnetic bubble memories.

Another object of the invention is to provide a method of fabricating bubble memories having no step in the permalloy patterns as they cross the underlying conductors without using resist lift-off techniques.

Still another object of the invention is to provide an improved magnetic bubble memory by means of a novel fabrication process.

SUMMARY OF THE INVENTION

These and other objects are accomplished in accordance with the invention by a method of fabricating magnetic bubble memory chips from a magnetic film having an insulating layer lying on one surface thereof. An aluminous layer of a first substantially uniform thickness is formed on the insulating layer. Subsequently, a layer of water insoluble material is formed on the aluminous layer. This water insoluble material may consist of silicon dioxide, or an oxidation resistant metal, such as chromium. Later, a mask is formed on the layer in soluble material for patterning control conductors for the memory. All regions of the water insoluble layer that are not covered by the mask are removed; and all regions of the aluminous layer that are not covered by the mask are thinned to a second substantially uniform thickness.

The thinned aluminous regions are subsequently exposed to deionized water at approximately 100° C. This produces a chemical reaction which converts the thinned aluminous regions to corresponding $Al_2O_3$ regions which actually are hydrated and also contain some water molecules, and simultaneously forms the control conductors. In this reaction, the thickness of the $Al_2O_3$ formed is approximately three times the thickness of the thinned aluminous regions. Thus, making the second uniform thickness approximately $\frac{1}{3}$ of the first uniform thickness, the $Al_2O_3$ regions that are formed have the same thickness as the conductors. And therefore, no step in the permalloy will result when they are made to cross over the conductors.

BRIEF DESCRIPTION OF THE DRAWINGS

Various preferred steps for fabricating magnetic bubble memories according to the invention will best be understood by reference to the following detailed description and accompanying drawings, where.

DETAILED DESCRIPTION

Figure 1:
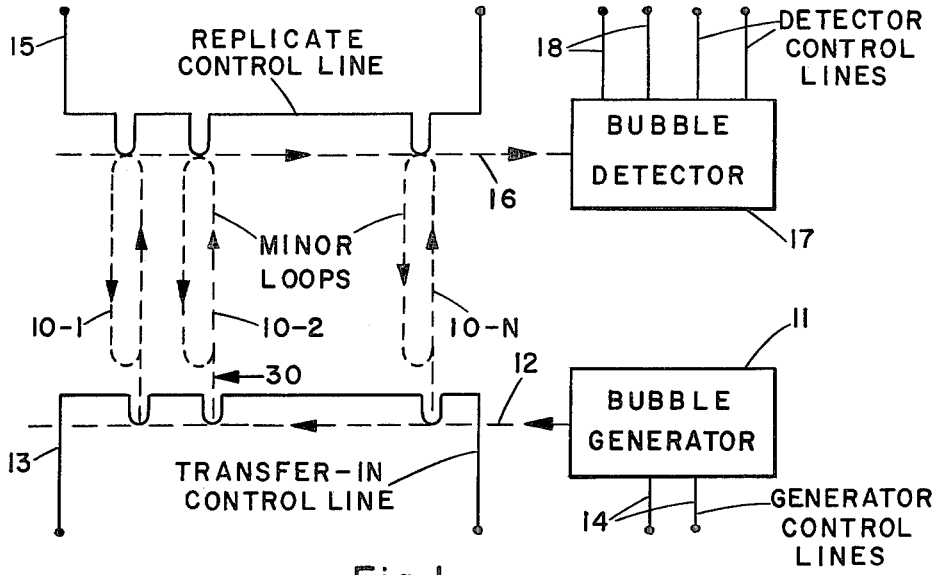
FIG. 1 is a schematic diagram of a bubble memory constructed according to the invention.

A bubble memory constructed according to the invention will now be described in conjunction with FIG. 1. In that memory, the bubbles are stored in a plurality of minor loops 10-1, 10-2, . . . 10-N. There the bubbles rotate as indicated by the arrows in FIG. 1 in response to a rotating magnetic field.

The memory also includes a bubble generator 11, a bubble propagation path 12 that connects generator 11 to the minor loops, and a transfer-in control conductor 13. In operation, magnetic bubbles are created by generator 11 in response to electrical signals that are externally applied to the generator's control conductors 14. The bubbles thus produced propagate along path 12 by the rotating magnetic field. Accordingly, individual bubbles or absence thereof are made to align with the minor loops. These bubbles are then transferred in parallel to the respective minor loops in response to signals applied to conductor 13.

In comparison, bubbles are read from the minor loops by means of a replicate control conductor 15, a bubble propagation path 16, and a bubble detector 17. Basically in operation, signals are applied to control conductor 15 in order to replicate on path 16 those bubbles or absence thereof that are in the minor loops adjacent to path 16. Subsequently, the replicated bubbles are propagated by the rotating magnetic field to bubble detector 17. There, the bubbles are serially detected, and signals representative thereof are generated on detector control conductors 18.

In the present invention, the above described components physically are packaged on a magnetic substrate having a first insulating layer on one surface. Control lines 13, 14, 15 and 18, formed of patterned aluminous conductors, lie on this first insulating layer. Filling the spaces between these conductors are a plurality of $Al_2O_3$ regions. These regions are of the same thickness as the conductors. A second insulating layer overlies both the conductors and the $Al_2O_3$ regions. On top of this second insulating layer lies a plurality of patterned permalloy regions. These permalloy regions are shaped to form minor loops 10-1 through 10-N, propagation paths 12 and 16, generator 11 and detector 17.

Figure 2:
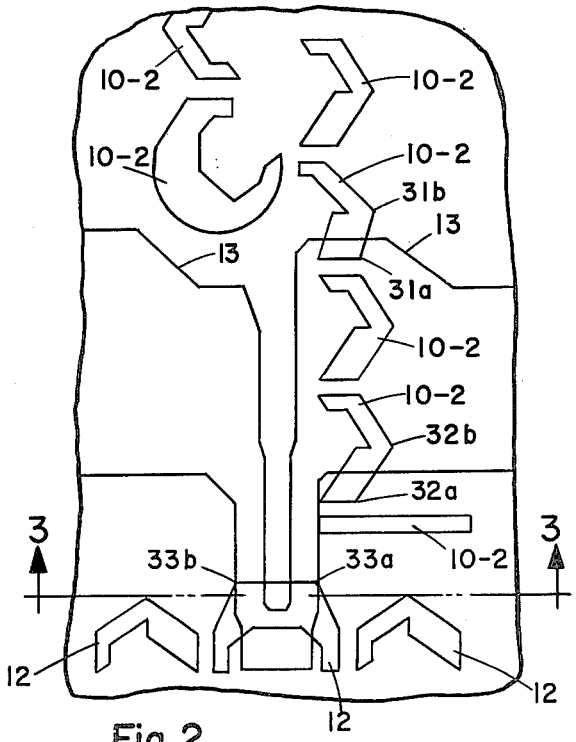
FIG. 2 is a greatly enlarged top view of a portion of the FIG. 1 memory.

Referring now to FIG. 2, there is illustrated a greatly enlarged top view of a region 30 in the FIG. 1 memory. In this figure, reference numeral 10-2 indicates a portion of one of the minor loops. Also, reference numeral 12 indicates a portion of one bubble propagation path and reference numeral 13 indicates a portion of the transfer-in control conductor.

As this figure indicates, some parts of loop 10-2 cross over other parts of conductor 13. This occurs for example, between points 31*a* and 31*b*, between points 32*a* and 32*b*, and between points 33*a* and 33*b*. It is particularly important to form these cross over points such that no step in the overlying permalloy occurs. This is because a step acts as a barrier to the propagation of bubbles. And as a result, operating margins for the memory are decreased.

Figure 3A:
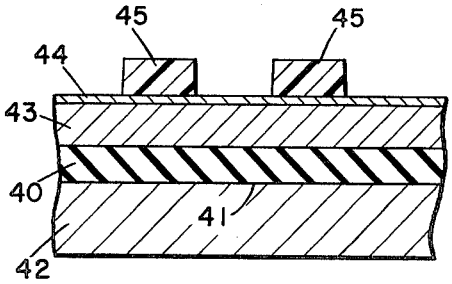
FIGS. 3A–3D are a set of cross sectional views taken along section lines 3—3 of FIG. 2 illustrating various stages of the disclosed fabrication process.

A process according to the invention that solves the above problem will now be described in conjunction with FIGS. 3A–3D. These figures are greatly enlarged cross sectional views taken along Section line 3—3 of FIG. 2 illustrating various stages of the fabrication process. FIG. 3A illustrates an initial stage. First, an insulating layer 40 is formed on a surface 41 of a magnetic film 42 such as garnet. Suitably, layer 40 consists of silicon dioxide and is 5000 angstroms thick. Lying on insulating layer 40 is an aluminous layer 43. Suitably, this layer consists of $AlC_u$, and is 4000 angstroms thick.

By subsequent steps of the process, layer 43 is patterned to form control lines 13, 14, 15, and 18 with regions of $Al_2O_3$ lying therebetween. To that end, a layer of water insoluble material 44 is formed on layer 43. Layer 44 may consist of silicon dioxide and be 1000 angstroms thick. Alternatively, layer 44 may consist of another water insoluble oxidation resistant metal, such as $C_r$ for example. Subsequently, a patterned mask 45 is formed on layer 44. This mask is patterned to form the previously described control conductors 13, 14, 15, and 18. The mask may be formed of a photoresist and be several thousand angstroms thick.

Figure 3B:
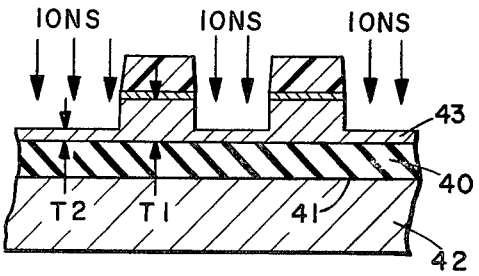

In a later step, all portions of layer 44 that are not covered by mask 45 are removed, and all portions of layer 43 that are not covered by mask 45 are thinned. This step is illustrated in FIG. 3B. Preferably, these removal and thinning steps are performed by ion-milling. Further details on ion-milling may be found, for example, in an article in Solid State Technology entitled "Ion-Milling For Semiconductor Production Processes" by Dr. L. Bollinger published in November, 1977.

There, etch rates for various materials, which include silicon dioxide and aluminum are tabulated. Knowing the etch rates and the thickness of layers 44 and 43, the resulting thickness of the aluminous material in the regions not covered by mask 45 can be controlled. Preferably, after the ion-milling step, the ratio of the thickness of aluminous layer 43 in the regions not covered by mask 45 to the thickness of aluminous layer 43 in the regions covered by mask 45 is approximately $\frac{1}{3}$. In other words, with reference to FIG. 3B, the ratio T2/T1 is one-third. The reason for this ratio will become apparent with an explanation of the next succeeding step.

Figure 3C:
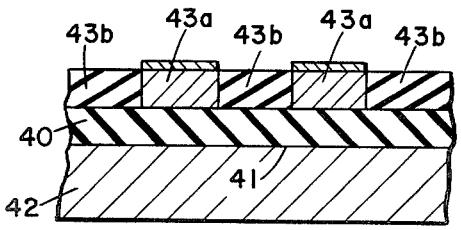

That step involves converting the thinned regions of layer 43 into corresponding regions of $Al_2O_3$ by a chemical reaction with water. The results of this step are illustrated in FIG. 3C. There, reference numerals 43*a* and 43*b* respectively indicate the patterned control lines and the $Al_2O_3$ regions lying therebetween. Preferably, the chemical reaction that converts the thinned regions of layer 43 into $Al_2O_3$ is performed by reacting those regions with deionized water at 80° C. to 100° C.

Comparison of FIGS. 3B and 3C shows that the $Al_2O_3$ regions have a thickness that is substantially greater than thickness T2 of the layer from which they were formed. More particularly, the thickness of the $Al_2O_3$ regions 43*b* is substantially the same as the thickness of the patterned control lines 43*a*. This result is explained by reference to FIG. 4.

Figure 4:
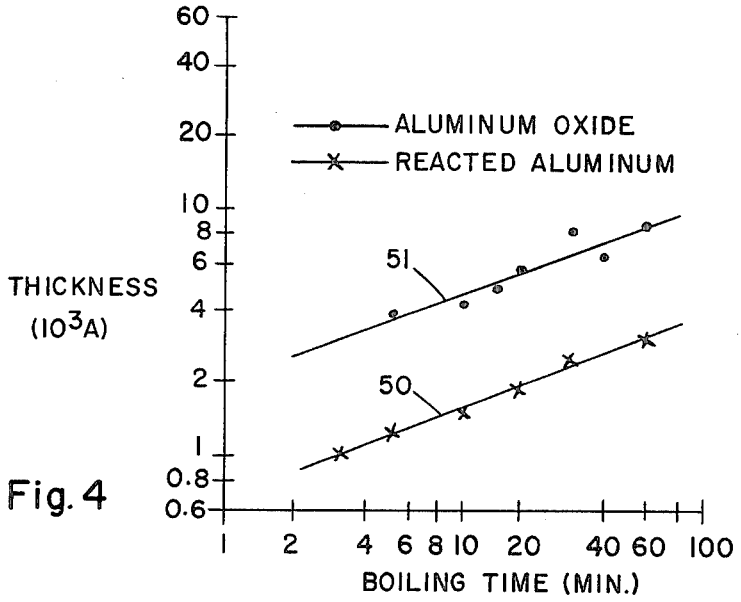
FIG. 4 is a set of curves explaining in greater detail, one of the steps of the FIGS. 3A–3D process.

FIG. 4 is from an article in the December 1976 IEEE Transactions On Reliability entitled "Application Of Aluminum Oxide To Integrated Circuits Fabrication". That article described how an aluminum plus water reaction can be used to drastically reduce chip failures that are due to defects in the protective encapsulation of the chip. The problem and method of solution there are totally different that those involved here; but the curves that are given in FIG. 4 have application here.

These curves correlate the thickness of a reacted aluminous layer to the thickness of the resulting aluminum oxide layer. A curve 50 gives the former, while curve 51 gives the latter. Inspection of these curves shows that the ratio of the thickness of the reacted aluminum to the thickness of the resulting aluminum oxide is approximately $\frac{1}{3}$. Thus to make regions 43*b* the same thickness as control lines 43*a*, the ion-milling step of FIG. 3*b* should proceed until thickness T2 is approximately $\frac{1}{3}$ of thickness T1.

Figure 3D:
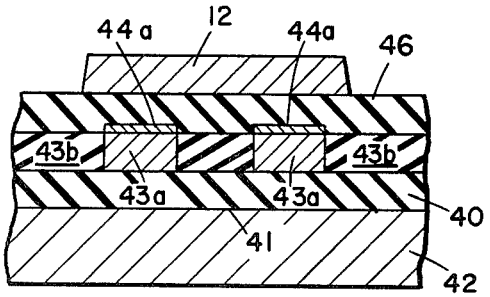

Now referring back to FIG. 3D, a cross sectional view taken illustrating a latter fabrication stage will be described. There, reference numeral 44*a* indicates that portion of the water insoluble layer 44 that remains on control conductors 43*a*. Also, reference numeral 46 indicates the insulating layer that lies between the control lines and the permalloy regions 12. Suitably, insulating layer 46 consists of silicon dioxide and is approximately 2000 angstroms thick. The important point of course to note about FIG. 3D is that due to the above described process, no steps occur at the crossover points between the control lines and the permalloy regions.

Various preferred steps for carrying out a process according to the invention have now been described in detail. In addition however, many changes and modifications may be made to these details without departing from the nature and spirit of the invention. It is to be understood, for example, that the process steps of FIGS. 3A–3D apply to all portions of any bubble memory that have a control conductor underlying patterned permalloy on which bubbles propagate. This occurs in the bubble generator, bubble replicator, bubble detector as well as in the bubble transfer in paths. Further, it is to be understood that the components may have a wide variety of top view patterns. Many such patterns have been described in the literature and need not be repeated here. Therefore, since many changes and modifications can be made to the above described details, it is to be understood that the invention is not limited to said details but is defined by the appended claims.

I claim:

1. A method of fabricating magnetic bubble memory chips from a magnetic film havng a first insulating layer of $SiO_2$ on one surface thereof, said method including the steps of:

forming an aluminous layer of AlCu on said first insulating layer, said aluminous layer having a first substantially uniform thickness;

forming a layer of water insoluble material on said aluminous layer;

forming a photoresist mask on said layer of water insoluble material for forming patterned control conductors for said memory;

removing all regions of said water insoluble layer that are not covered by said mask;

thinning to a second substantially uniform thickness all regions of said aluminous layer that are not covered by said mask; and converting said thinned aluminous regions to corresponding $Al_2O_3$ regions by a chemical reaction with water to form said patterned control conductors with said $Al_2O_3$ regions lying therebetween.

2. A method according to claim 1 where said converting step is performed by reacting said thinned aluminous regions with deionized water at 80° C.–100° C.

3. A method according to claim 1 wherein said water insoluble layer consists essentially of $SiO_2$.

4. A method according to claim 1 wherein said water insoluble layer consists of an oxidation resistant metal.

5. A method according to claim 4 wherein said oxidation resistant metal is chromium.

6. A method according to claim 1 wherein said second thickness is approximately one third of said first thickness.

7. A method according to claim 6 and further including the steps of:

forming a second insulating layer of $SiO_2$ over said patterned control conductors and said $Al_2O_3$ regions; and forming permalloy regions over said second insulating layer, at least some of which cross over said patterned control conductors, whereby no steps occur at the crossover points between said patterned control conductors and said permalloy regions.

8. A method according to claim 1 wherein said removing and thinning steps are performed by ion-milling.

* * * * *